United States Patent [19]

Heilig

[11] Patent Number: 4,742,771

[45] Date of Patent: May 10, 1988

[54] POSTAL CODE ENVELOPE PRINTER

[76] Inventor: Lewis A. Heilig, 5785 Sir Walter Scott, Apt. 201, Montreal, Quebec, Canada, H4W 1S4

[21] Appl. No.: 41,530

[22] Filed: Apr. 23, 1987

[30] Foreign Application Priority Data

Apr. 28, 1986 [CA] Canada ..... 507799

[51] Int. Cl.[4] ..... B41K 3/04

[52] U.S. Cl. ..... 101/407 BP; 101/327; 101/103; 33/562; 248/448; 401/193; 434/364

[58] Field of Search ..... 101/407 R, 407 A, 407 BP, 101/126, 103, 327, 333, 334; 434/364, 164; 33/562, 563, 1 B, 15, 1 BB, 1 F; 401/193; 400/137, 138.1, 138.4, 135, 134.4; 248/448; 273/309, 240

[56] References Cited

U.S. PATENT DOCUMENTS

| | | | |
|---|---|---|---|
| 1,887,163 | 11/1932 | Lorber | 434/164 |
| 2,538,318 | 1/1951 | Mitchell | 248/448 |
| 2,690,017 | 9/1954 | Neill | 33/563 |
| 3,370,532 | 2/1968 | Falk | 101/103 |
| 3,603,592 | 9/1971 | Bury | 273/240 |
| 3,857,224 | 12/1974 | Hewitt | 101/334 |
| 4,172,419 | 10/1979 | Munyon | 101/327 |
| 4,237,784 | 12/1980 | Suzuki | 400/138.4 |
| 4,586,906 | 5/1986 | Buccieri, Jr. | 33/562 |
| 4,607,433 | 8/1986 | Meeker | 33/363 |
| 4,622,897 | 11/1986 | Laverick et al. | 101/407 BP |

*Primary Examiner*—William Pieprz
*Attorney, Agent, or Firm*—William H. James

[57] ABSTRACT

A machine printer for marking a machine readable code on envelopes and the like allows house holders and small businesses to print the postal precode on envelopes so they can be read by a machine reader rather than a keypunch operator. The printer has an adjustable jig to hold one end of an envelope, the jig has two portions which join together in sliding relationship for different sized envelopes. Each portion has a corner slot to position an envelope, and at least one of the portions has a stencil or other marking means for producing a mark on an envelope, the stencil or other marking means located a fixed distance from one corner of the envelope.

21 Claims, 8 Drawing Sheets

Numeric Format

10110-1011

BARZIP Format

POSTAL CODE ENVELOPE PRINTER

FIELD AND BACKGROUND OF THE INVENTION

The present invention relates to marking envelopes and the like for mechanical sorting. More specifically, the present invention provides a manual printer for printing a code that can be read by a mechanical sorter on envelopes and the like.

Most countries including Canada and the United States utilize a postal or zip code for the distribution of mail. The United States has adopted a numeric code of five to nine digits. This code is applied by writing or printing directly onto an envelope so it can be read by a keypunch operator who prints a machine readable fifty two bit bar code along the bottom of each envelope. The readable bars allow the envelope to be sorted by a mechanical sorting device. An additional universal machine readable precode matrix may also be used as a method for coding a machine readable format or hand addressed mail in order to reduce the number of envelopes that have to be read by keypunch operators. At the present time, this universal precode matrix is used in Canada by large volume mailers, such as banks, public utilities and the like. Additionally in Canada, consumers have hand coded nearly one hundred million Christmas card envelopes with this same universal precode matrix. The universal precode includes two sets of preprinted machine readable bar markings. The proposed facing identification marks (FIM) consisting of five vertical bars, are positioned adjacent the top right hand corner of the envelope, and the matrix code consisting of eleven vertical bars are positioned adjacent the bottom right corner of the envelope. The location of the FIM and matrix codes on the envelope is important in order for the machine to read the codes. If the codes are not in a predetermined location from top and bottom corners of an envelope, then the machine reader rejects it, and it is passed to a keypunch operator.

Use of the term "envelope" herein refers to not just envelopes of different sizes, but also cards such as post cards, courtesy reply cards and business reply cards, stick on labels for attaching to large envelopes, packages and parcels. In the future, machine readers may well be able to read a code located in a predetermined position on a label which may or may not have to be positioned in a particular location on a package.

In general, bar codes have been widely accepted by large volume mailers and internally benefits the post office. The mail passes faster through machine readers when a bar code is printed thereon, and users of a bar code system have benefited with the faster and more consistent response time. Furthermore, the post office has benefited by reducing the number of keypunch operators as a machine reader can read bar codes at a much higher speed than a human can read the written zip code.

SUMMARY OF THE INVENTION

It is an aim of the present invention to provide a simple economic printer suitable for use by households and small businesses that can print a precode matrix on any size of envelope. By utilizing this printer and printing the precode matrix on an envelope, all mail users are able to benefit in the same way that large volume mailers have, by having a faster and more consistent mail delivery. Furthermore, by more extensive use of the precode matrix, the postal system is able to streamline sorting procedures.

It is a further aim of this invention to provide a simple printer that can be used for printing any type of optical reader code on sheets, cards or the like, such that the cards can be sorted, catalogued, used for feeding information to a computer, or any other required use. The code is preferably a bar code which can be extrapolated in terms of letters and/or numbers.

The present invention provides a printer for marking an envelope and the like, at a fixed location from one corner of the envelope regardless of envelope size, comprising adjustable jig to hold one end of an envelope, the jig having at least two portions, each portion having a corner slot means to position a corner on the one end of the envelope, the two portions joined together in sliding relationship so that distance between the corner slot means in the two portions can be varied to hold different sized envelopes; at least one of the two portions having a stencil for producing a mark on the envelope, the stencil adapted to be positioned above a portion of the envelope in the jig, the stencil located a fixed distance from the corner slot means such that the portion of the envelope to be marked is a fixed distance from the one corner of the envelope regardless of size of envelope.

In one embodiment the printer has a top portion with an FIM stencil comprising a row of slots and a bottom portion with a matrix stencil comprising a plurality of rows of slots, the two stencils adapted to permit FIM and precode matrix to be marked on an envelope for machine sorting. In another embodiment, the matrix stencil is removable from the bottom portion of the jig and including other matrix stencils representing a specific zip code for replacement in the bottom portion of the jig. In a still further embodiment, the corner slot means used to retain an envelope may be replaced with a parcel adapter for printing on parcels and packages in a predetermined configuration.

The printer need not be restricted to one having a stencil, but may have a stamp with a desired code or mark thereon, mounted at one end of a plunger the stamp is adapted to either directly or indirectly produce a mark on an envelope.

BRIEF DESCRIPTION OF THE DRAWINGS

The bar code readers used in The United States postal sorting offices could easily be modified to recognize a predetermined pattern of bars having predetermined size and shape on predetermined positions on an envelope. For this reason, the printing of the FIM and matrix must be kept within precise limits on the envelope. FIG. 1 shows an envelope 10 which has the normal address and zip code 12 printed thereon. The FIM code markings 14 are five vertical bars located at a predetermined distance from the top right corner of the envelope 10. The FIM must be on the envelope, if it is not, then a machine reader sends the envelope for manual reading and marking. Once the FIM is read by the reading machine, the envelope is then fed to another reading machine which reads the precode matrix. The precode matrix 16 is located at a predetermined distance from the bottom right hand corner of the envelope 10.

Figure 1:
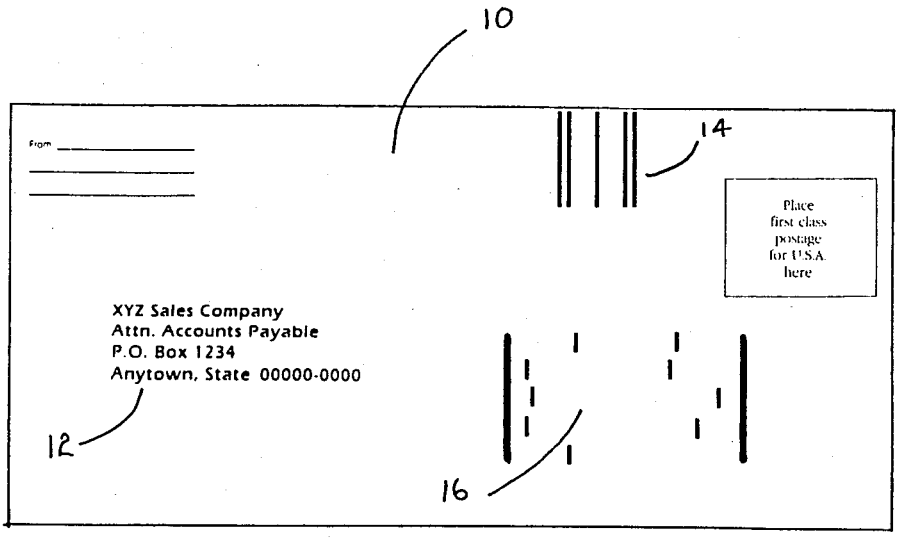
FIG. 1 shows an envelope with an address, zip code, FIM and precode matrix printed thereon.
Figure 2:
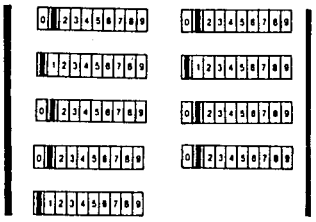
FIG. 2 shows the numeric format used for the precode matrix.

The precode matrix as shown in FIG. 2 is a numeric format which has five horizontal rows spaced vertically apart followed by four horizontal rows spaced vertically apart. Two obligatory bars are positioned near the outside ends of all the rows. The two end bars form the matrix frame bars. The matrix then provides spaces for numerals 0 to 9 in each of the rows. From this format the desired zip code is selected and a bar is placed in the selected numerical location for each of the nine rows representing the zip code. Optionally the first five rows may be used if the full 9 digit zip code is not available. The mechanical reader determines the code from this printed matrix for sorting and distribution of mail. It will be appreciated that the location of the matrix frame bars is important as is the spacing for the bars representing the zip code in order for the mechanical reader to correctly read the zip code.

Figure 3:
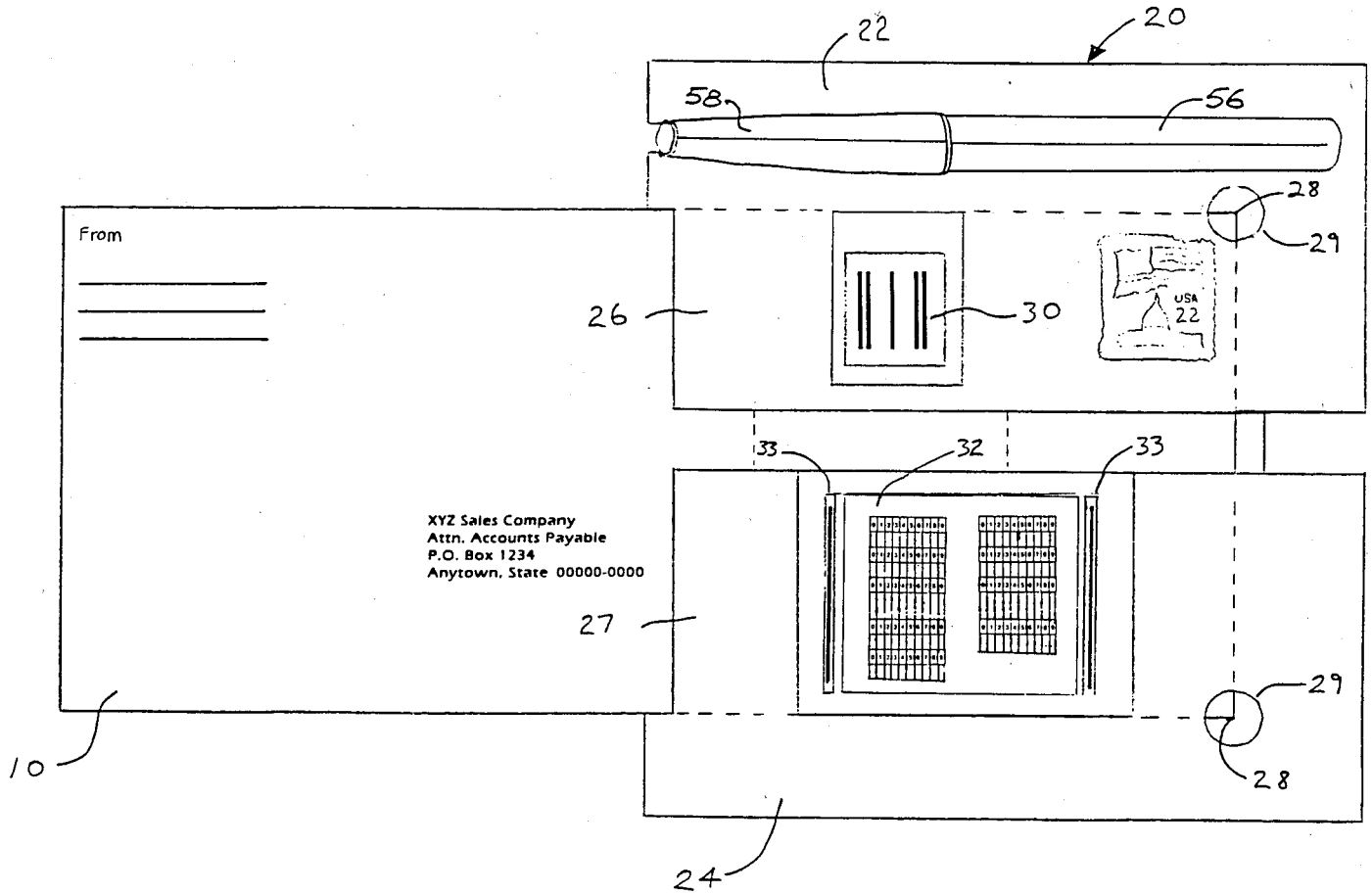
FIG. 3 is a top plan view showing one embodiment of a printer of the present invention, with an envelope positioned therein.

One embodiment of a printer 20 is shown in FIG. 3 having a top portion 22 and a bottom portion 24. The top portion 22 and the bottom portion 24 are joined together in sliding relationship so that they may be moved backwards and forwards to allow insertion of an envelope 10. The arrangement for sliding the portion apart is designed not to skew so the two portions are always parallel to each other. An FIM cover 26 is mounted on a raised edge around the top portion 22 forming a cavity for the envelope 10 to fit therein and a matrix cover 27 is mounted on a raised edge around the bottom portion 24 forming a cavity for the envelope 10.

The envelope cavities are aligned so the envelope slides into the cavities. Both cavities have corners 28 for positioning the envelope. As can be seen in FIG. 3, observation holes 29 are provided in the covers 26 and 27 over the corners 28 so that a user can ensure that the envelope corners are properly located in the cavity corners 28. In one embodiment a bright color may be applied to the underside of the cavity in the top portion 22 and bottom portion 24 of the jig. This bright color would be covered when an envelope is inserted in the cavity and has its corners in the cavity corners 28. Blocking of the coloured surface confirms visually that the envelope is aligned. Thus the envelope 10 can be placed in the jig 20, the top portion 22 and the bottom portion 24 pushed together so that the corners of the envelope are positioned in the corners of the cavities. FIM slots 30 in the FIM cover 26 are positioned at the correct location for printing on the envelope, and a precode matrix stencil 32 in the matrix cover 27 is also positioned so that by marking in the desired slots on the matrix stencil 32, the correct precode can be printed on the envelope. Channels 33 on each side of the matrix stencil provide for a stylus to conveniently mark the matrix frame bars which are obligatory for all precodes.

Figure 4:
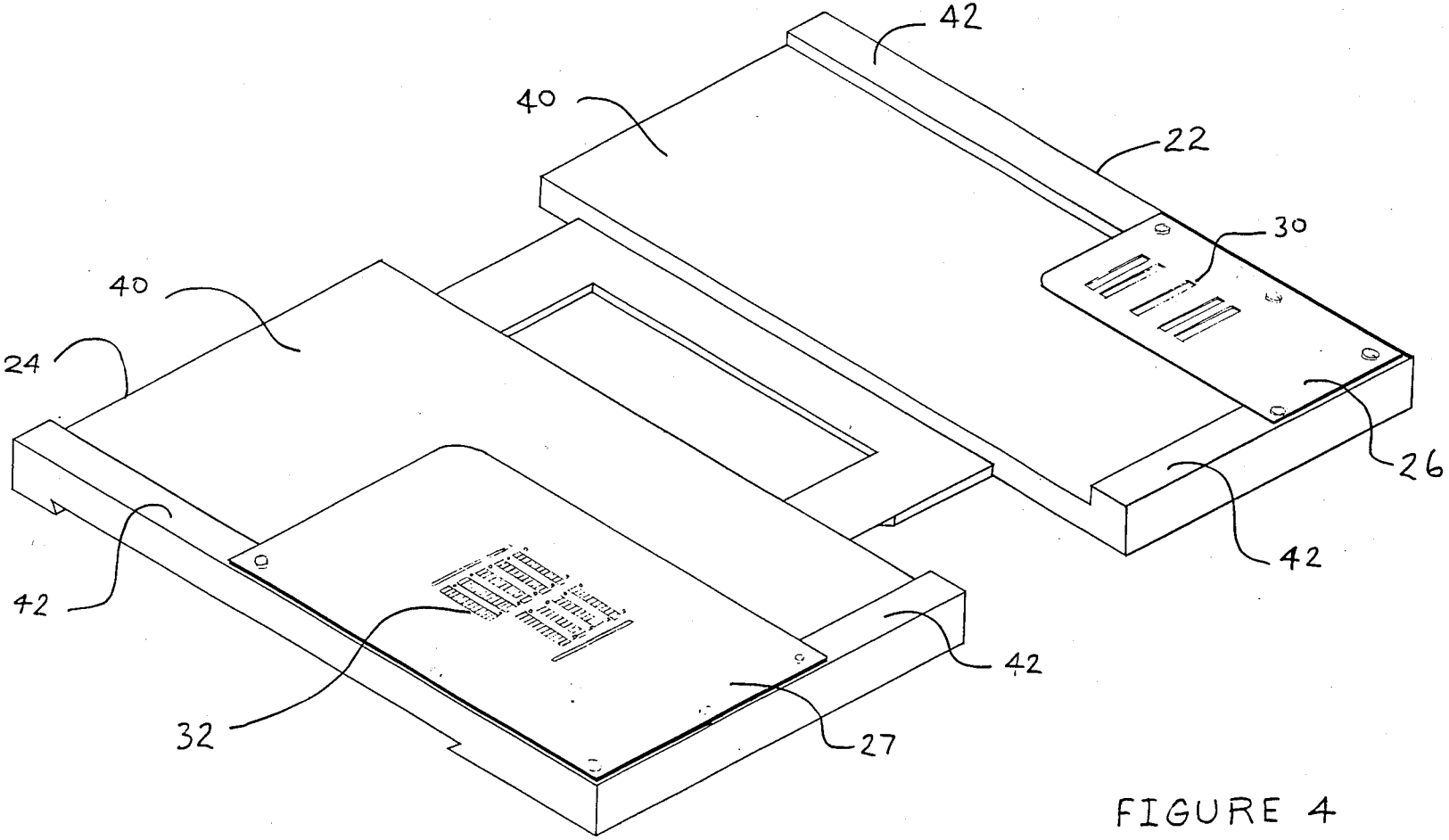
FIG. 4 is a top isometric view showing another embodiment of a printer according to the present invention.

FIG. 4 illustrates another embodiment of a printer. An envelope receiving surface 40 is provided on the top portion 22 and the bottom portion 24 so that the raised edge 42 has a step to act as a guide to retain the envelope 10 in the desired location. The FIM cover 26 and the matrix cover 27 only extend over the corners of the top portion 22 and bottom portion 24 and rest on the raised edges 42 of the top portion 22 and bottom portion 24 thus forming the cavities for the envelope to be inserted for printing.

Figure 5:
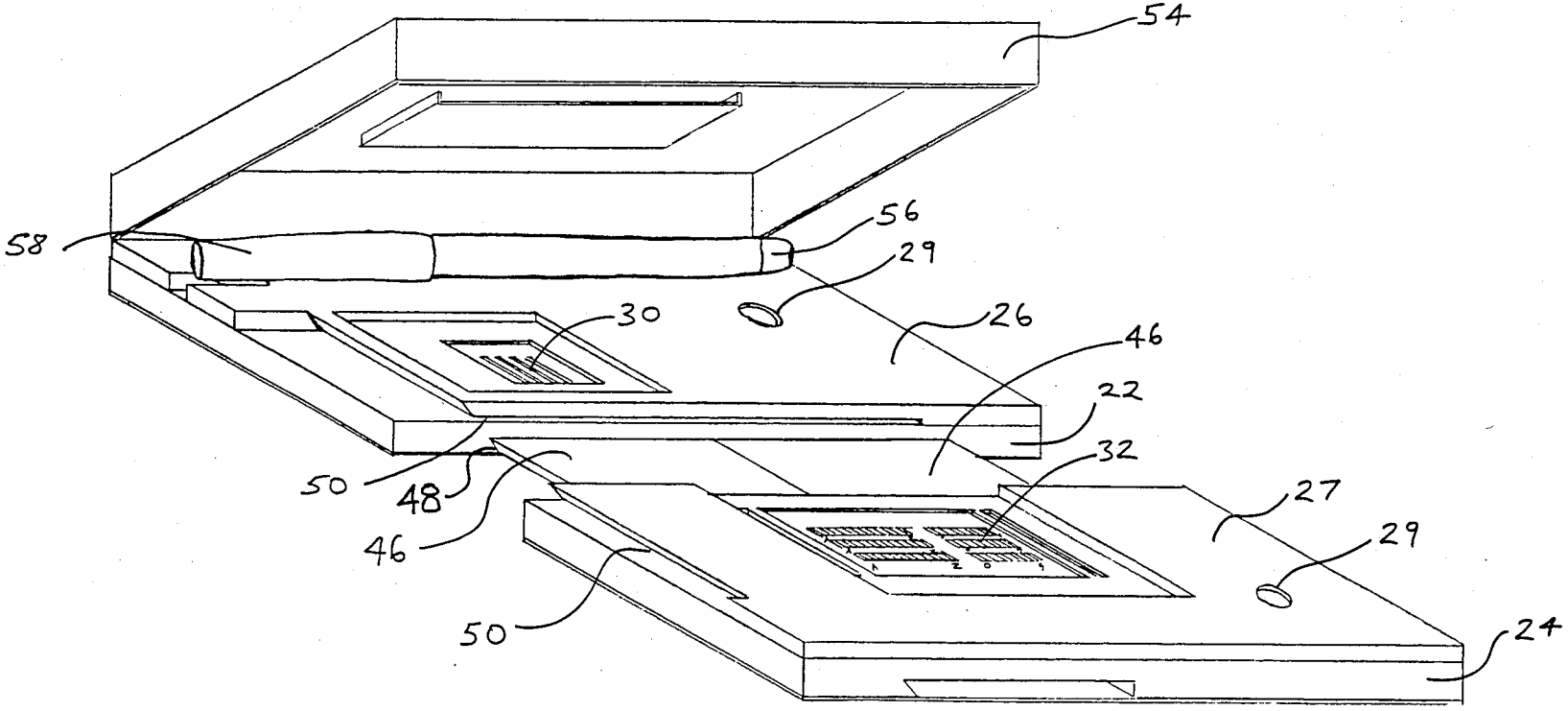
FIG. 5 is a top isometric view of the printer shown in FIG. 3.

FIG. 5 illustrates the printer shown in FIG. 3, the top portion 22 has arms 46 which engage in grooves 48 in the bottom portion 24. The arms 46 slide backwards and forwards in the grooves 48 and this assures that the top portion 22 always remains parallel with the bottom portion 24 and the two portions do not skew when opening and closing.

Figure 6:
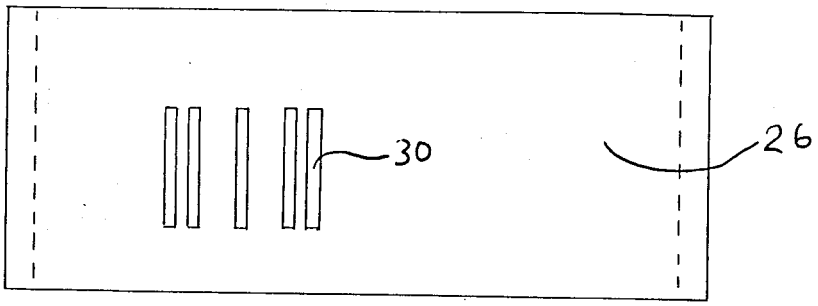
FIG. 6 is a detailed plan view showing an FIM stencil.
Figure 7:
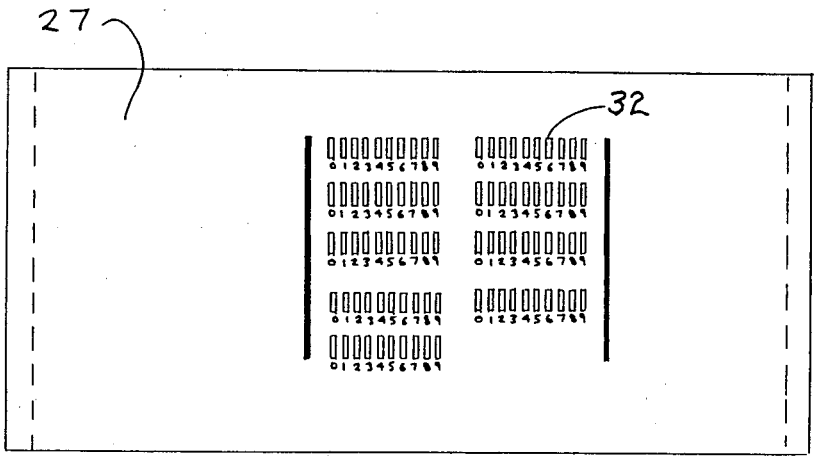
FIG. 7 is a detailed plan view showing a precode matrix stencil.

FIG. 6 shows the FIM cover 26 which is preferably formed from a metal sheet or plate with the FIM slots 30 cut out. The cover 26 is comparatively thin allowing a pen or stylus to pass over the slots 30 and mark the envelope. FIG. 7 shows the matrix cover 27 for the precode matrix stencil 32. The slots in the stencil 32 are cut out of a metal sheet or plate. As can be seen in FIG. 7, the stencil 32 has nine rows of slots arranged in five spaced apart horizontal rows followed by four spaced apart horizontal rows with numerals marked thereon so a user can mark the specific zip code onto the envelope.

Figure 8:
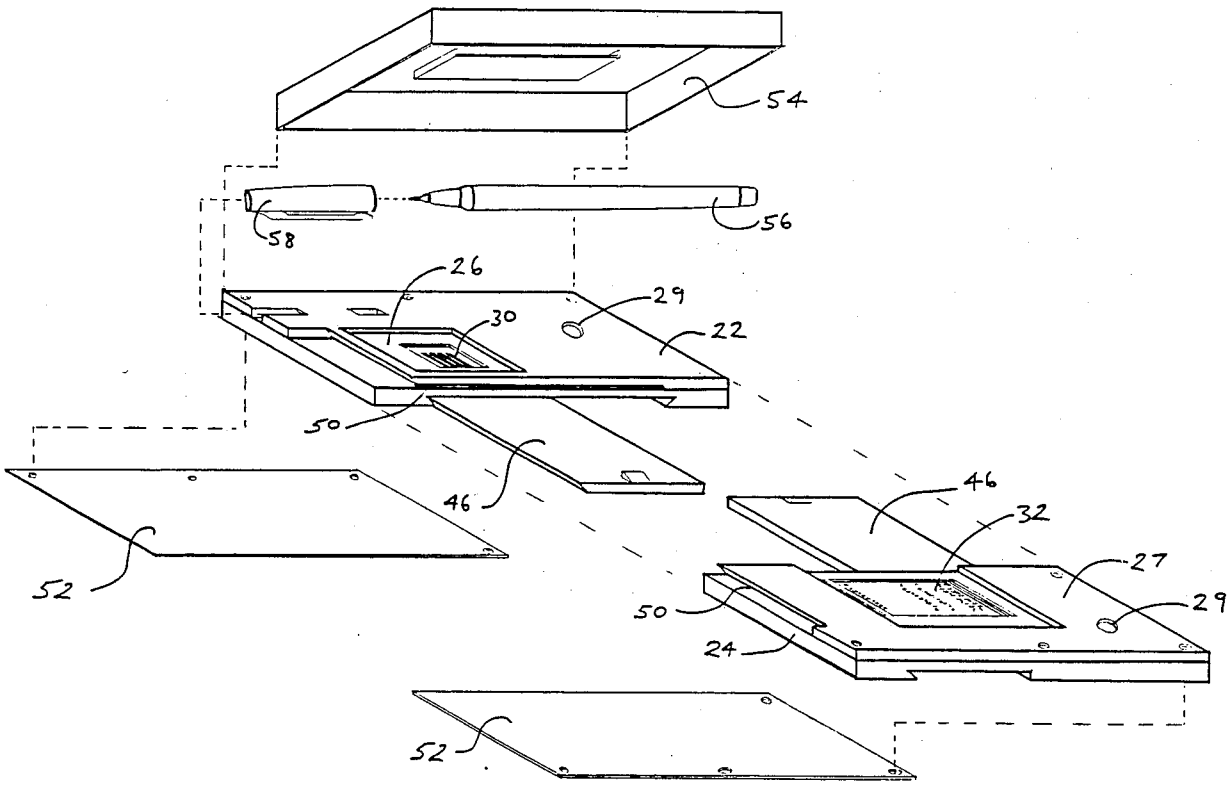
FIG. 8 is an isometric exploded view showing another embodiment of a printer according to the present invention.

FIG. 8 illustrates another embodiment of a printer showing the two guide arms 46, one attached to the top portion 22 and the other to the bottom portion 24. The guide arms fit into adjacent grooves in the opposing portions and ensure that as the top portion 22 and bottom portion 24 move apart, they do not skew, thus ensuring that the two portions always remain substantially parallel to each other. As can be seen, both portions 22 and 24 have envelope cavities 50 with bevelled edges for ease of insertion of an envelope. The thickness of the cavities 50 can be varied, but in most cases need not be more than the thickness of an envelope as it is preferred to print the precode matrix on an empty envelope. Bottom covers 52 are shown which attach to both the top portion 22 and bottom portion 24 of the printer and a cover 54 is provided which encloses the two portions 22 and 24 when they are together. The cover 54 which is hinged to close over the printer protects the metal stencil plates from damage and allows for the storage of stamps, return address labels etcetera.

In another embodiment, a thumb wheel may be provided to lock the arms 46 in grooves 48 so that the top portion 22 and the bottom portion 24 are held rigidly in one particular location for a particular size of envelope. Radiussed edges may be provided for slots to hold the envelope for ease of insertion and in yet a further embodiment, hinges may be included at the edges of the covers 26 and 27 so they may be opened to allow access to the cavities 50 for cleaning the internal surfaces.

FIGS. 3, 5 and 8 all show a printer 20 that includes a stylus 56 with a cap 58 attached to the top portion 22. The stylus 56 is a pen using black ink which does not contain a red dye base so that markings from the pen can be read by the reading machine. By ensuring the cap is provided on the printer, this reduces the chance of the pen being lost and also ensures that this particular pen is used for marking the envelope. Many standard pens have a red dye base even though the ink appears blue or black. This type of dye base may not be satisfactory for machine reading. Whereas the stylus 56 is defined as a pen, in another embodiment a marking sheet, such as carbon paper or other similar type of transfer paper may be placed under the stencil and on top of the envelope. The stylus is a plain marker which when pressed on the marking sheet through the stencil, applies the marking code to the envelope. The marking sheet transfers a mark to the envelope which is machine readable.

The machine readable marks applied by the stylus 56 include magnetic, phosphorescent, and other suitable machine readable inks, dyes. etc.

In operation, an envelope to be precoded is inserted into the cavities 50 and the top and bottom portions 22 and 24 are pushed together so that the envelope corners fit into the cavity corners 28. It must be assured that the envelope is not skewed, but is straight and parallel to the edges of the top and bottom portions 50. The marker pen 56, which is the correct pen for marking and not a red dye base pen, is then used to place the five FIM bars through the FIM slots 30 onto the envelope. Next the pen is used to insert the matrix frame bars by running it down the channels 33 on each side of the matrix stencil 32 as shown in FIG. 3. The zip code is then marked in the slots of the matrix stencil 32 representing the particular code. The code is marked in order starting at the top left hand row of slots and reading along to the right and then continuing down to the fifth row, to the top right hand row of slots, and down to the fourth row, so that the code represents up to nine numbers. Where the five digit code is used, only the five left hand rows are mandatory.

Once the envelope has been marked, it can be removed and re-inserted and the code can be checked to ensure that it has been been correctly marked. The written or printed address on the envelope should preferably not be superimposed over the precode matrix as it may interface with the machine reader.

In one embodiment, the stencil may take the form of having a plurality of boxes for placing a number, letter or other mark within each box. The box size limits the size of the marks, be they numbers, letters or other marks, and the position of the stencil locates the position of the marks, be they numbers, letters or other marks, on the envelope.

In another embodiment the matrix stencil 32 is on a removable plate that fits into a holder in the matrix cover 27. This permits a precoded matrix stencil to be inserted therein. Separate matrix stencils are useful when many envelopes are to be sent to the same address. Such a precoded matrix stencil would be made with only the matrix frame slots and the slots necessary for the particular zip code. Numerous stencils could be made for different addresses.

In another embodiment, the lower section of both the top and bottom portions 22 and 24 may be removed and replaced by corner legs so that the printer could be used on a parcel or package and printing in a predetermined configuration on the parcel or package. Such a system would be useful when optical scanners are used to index parcels instead of manual keypunch sorting.

Figure 9:
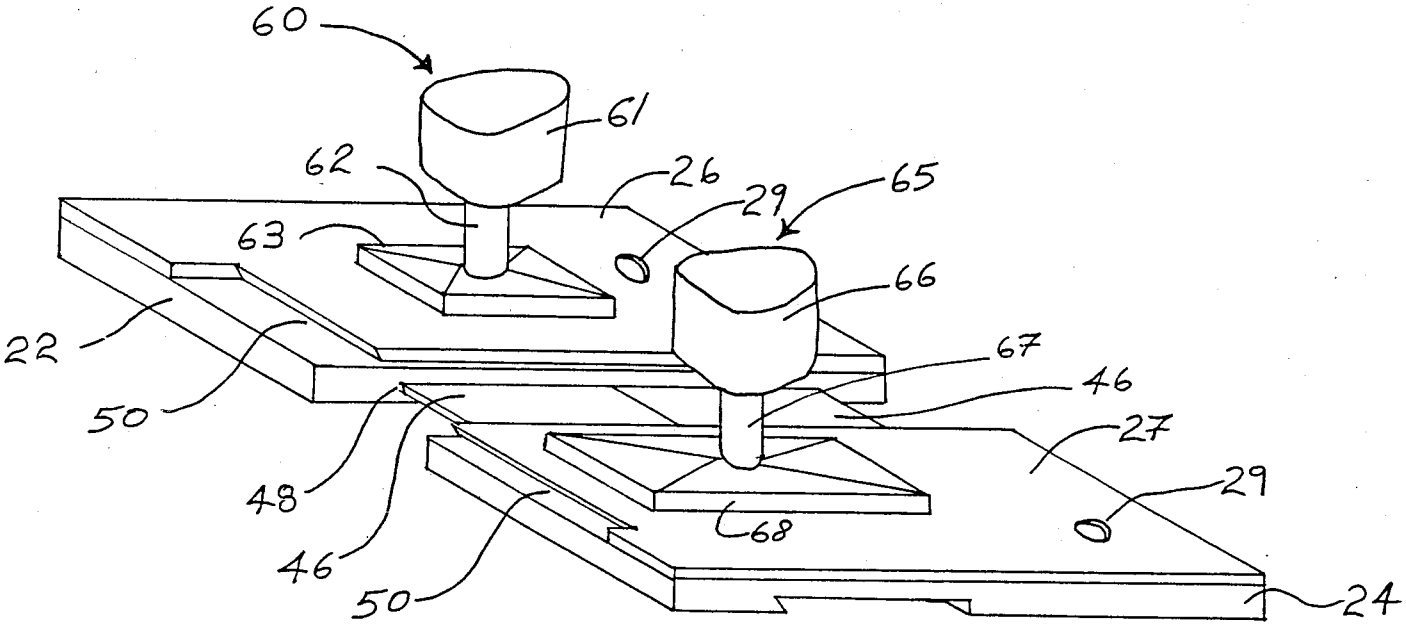
FIG. 9 is a top isometric view showing one embodiment of a printer of the present invention having two plunger type stamps for marking envelopes.

The printer shown in FIG. 9 has a top portion 22 with an FIM cover 26 mounted on the top portion and having a cavity 50 for an envelope to fit therein. The bottom portion 24 has a matrix cover 27 mounted thereon leaving a cavity 50 which lines up with the cavity in the top portion 22. Arms 46 slide backwards and forward in grooves 48 to ensure that the top portion 22 always remains parallel with the bottom portion 24 and the two portions do not skew when opening and closing.

An FIM marker 60 has a handle 61, connected to a plunger 62, which is spring loaded and has a rubber pad 63 at the base thereof. The rubber pad has the FIM pattern on it, and is positioned in the correct location on the FIM cover 26 for printing the pattern on an envelope. In a preferred embodiment, the rubber pad is a self-inking rubber stamp which can be used a considerable number of times.

Figure 10:
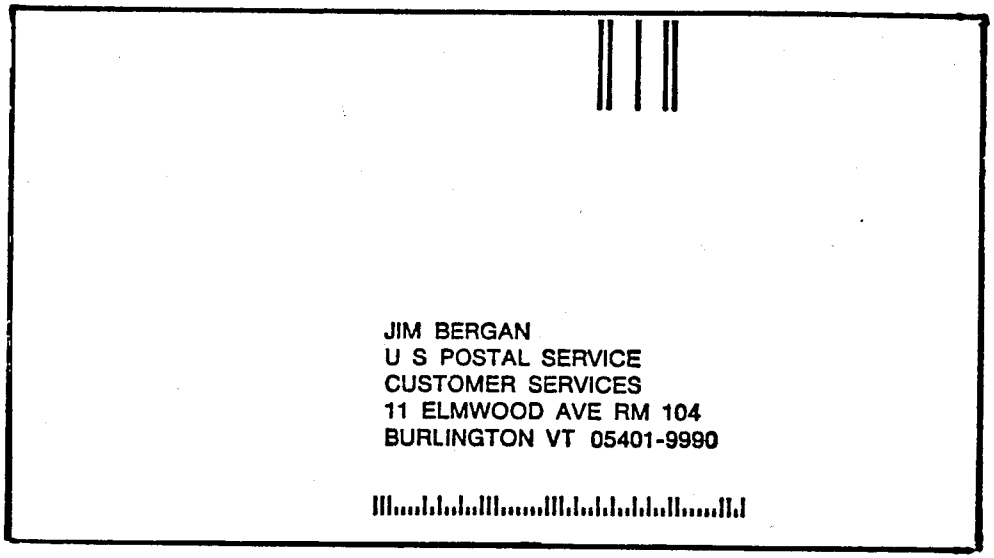
FIG. 10 shows an envelope with an address, zip code, FIM and bar code printed thereon.

A matrix marker 65 has a handle 66, plunger 67, and rubber pad 68. In the preferred embodiment, the rubber pad is a self-inking rubber stamp with a selected pattern molded or cut thereon. This cut or molded pattern which corresponds to a unique zip code, may follow the format as shown in FIG. 2 or may follow the fifty two bar code pattern as shown in FIG. 10, which is presently used in the United States by large volume mailers. Thus, the printer of this embodiment is applicable for marking return address or courtesy reply envelopes. Such a printer may be used by small companies and organizations. This device avoids the necessity of having to have return self-addressed envelopes specially printed with both the FIM and matrix patterns.

In operation, an envelope to be pre-coded is inserted into the cavities 50 ensuring that the envelope corners fit into the cavity corners. Observation holes 29 are provided to ensure that the envelope is in place, and the surface of the top and bottom portions 22 and 24 may be colored or in some way made of a different material that is clearly visible and is covered up when the envelope is in place. By blowing through these observation holes 29, paper particles and other foreign material that may remain in the cavities 50 is removed.

The handles 61 and 66 on the FIM marker 60 and matrix marker 65 may be depressed so that the rubber stamp 63 and 68 marks the envelope in the cavities 50. The top surface of the cavity 50 in the FIM cover 26 and the matrix cover 27 may have raised portions where the marks are to be applied and these raised portions extend to the entrance to the cavity 50 so that the envelope can be pulled back without the marks placed on the envelope touching the top surface of the cavity 50. This avoids smearing the marks on an envelope.

Foam resilient pads may be positioned on the lower surface of the cavity 50 for both the marking area of the FIM and the matrix. The resilient foam pad accommodates envelopes that have flaps or folds on their undersurface when a pressure marker is used, such as a stamp. The resilient pad takes into account variations in thickness of the envelope and ensures that the mark is consistent and does not leave areas lighter or darker than other areas.

Whereas a stamp or pad has been described of the self-inking rubber type, it will be apparent that the stamp need not necessarily have ink pressed into it, but may produce a mark by pressing onto a transfer material which is placed over the surface of the envelope. In another embodiment, the envelope itself may be coated or surface treated for heat sensitivity and the stamp is heated to cause a mark to appear on the envelope. The stamp and the transfer material may be combined or separate components. The transfer material may be any one of a number of available transfers made from suitable material.

Whereas the plungers illustrated in FIG. 9 are shown to be manually operated by pressing down on the handles 61 and 66, this manual operation may be replaced by an electric activated device such as a solenoid or other electro-mechanical device which can control both pressure and duration of the stamping action.

In another embodiment, the matrix stamp 68 could be large enough to include the written address, particularly in the case of a return self addressed or courtesy reply envelope. Alternatively, a separate stamp containing the written address may be mounted on the matrix cover 27. In yet a further embodiment, the inclusion of an alternate stamp or the same stamp as the FIM stamp 60, may include the stamp permit number for postage. Other features may be separate or include stamps for lines to identify the return senders address. The marker assemblies as shown herein, may be integral with the covers 26 and 27, or may be held by indents or other locating means on the top surface. This may be particularly useful when there are different bar code stamps to be used, and it may then be necessary to either change the complete stamp, or just the stamp pad itself. In yet a further embodiment, the stamp pad may be removed and a stencil as described herein located in the area to be marked.

This embodiment described herein is of particular use for preparing return address or courtesy reply envelopes and may equally well be used for other postal systems in countries that utilize mechanical sorting devices with a machine detection for a positioned pattern of marks.

Various changes may be made to the embodiments described herein without departing from the scope of the invention which is limited only by the following claims.

The embodiments of the invention in which an exclusive property or privilege is claimed are defined as follows:

1. A printer for marking an envelope and the like, at a fixed location with respect to one corner of the envelope regardless of envelope size, comprising:

an adjustable jig to hold one end of an envelope, the jig having at least two portions, each portion having a corner slot to position a respective corner of the one end of an envelope, connection means to join the two portions together in sliding relationship so that distance between the corner slots in the two portions can be varied to hold different sized envelopes;

the two portions of the jig each having stencil for producing a mark on separate locations of the envelope each stencil being positioned above the respective separate location on the envelope in the jig, the stencil above each separate location being a fixed distance from the respective corner slot such that each of the separate locations on the envelope to be marked is a fixed distance from the respective corner of the envelope regardless of size of envelope.

2. The printer according to claim 1 wherein one of the stencils comprises a plurality of slots and including a marker means to mark the location on the envelope through selected slots to produce a bar code on the envelope.

3. The printer according to claim 1 wherein a top portion of the jig has an FIM stencil comprising a row of slots and a bottom portion of the jig has a matrix stencil comprising a plurality of rows of slots, the two stencils adapted to permit FIM and precode matrix to be marked on an envelope for machine sorting.

4. The printer according to claim 3 wherein the FIM stencil and matrix stencil are both formed of prepunched metal plates.

5. The printer according to claim 1, wherein a stylus holder is attached to one position of the jig, and including a stylus to removably fit in the holder and produce a machine readable mark on the envelope through the stencil.

6. The printer according to claim 3 wherein the matrix stencil is removable from the bottom portion of the jig and including other matrix stencils representing a specific zip code for replacement in the bottom portion of the jig.

7. The printer according to claim 3 wherein the matrix stencil has nine rows of slots, for selecting a desired zip code, the nine rows of slots located between obligatory matrix frame bars required for machine sorting.

8. The printer according to claim 3 wherein the FIM stencil has five vertical slots near a top right hand corner of the envelope and is obligatory, and the matrix stencil has nine rows, each of the rows having ten slots for selecting a desired zip code, five rows on the left hand side and four rows on the right hand side, with obligatory matrix frame bars outside the nine rows, the matrix stencil being near the bottom right hand corner of the envelope.

9. A printer for marking an envelope and the like, at two fixed locations from each of the two corners of the envelope regardless of envelope size, comprising:

an adjustable jig to hold one end of an envelope, the jig having at least two portions, each portion having a corner slot to position a respective corner of the one end of an envelope, connection means to join the two portions together in sliding relationship so that distance between the corner slots and the two portions can be varied to hold different sized envelopes;

the two portions of the jig each having marking means secured thereto to each produce a mark at separate locations on the envelope, the marking means each located a fixed distance from the respective corner slot such that each of the separate locations on the envelope to be marked is a fixed distance from the respective corner of the envelope regardless of size of envelope.

10. The printer according to claim 9 wherein one of the marking means comprises a stamp positioned at one end of a plunger, the stamp adapted to produce a mark on the envelope.

11. The printer according to claim 10 wherein the stamp is a self-inking rubber stamp and represents a specific zip code.

12. The printer according to claim 9 wherein a top portion of the jig has marking means to permit FIM to be marked on an envelope for machine sorting and a bottom portion of the jig has marking means to permit a matrix to be marked on the envelope for machine sorting.

13. The printer according to claim 12 wherein the marking means comprises a separate stamp for the top portion and a separate stamp for the bottom portion, each stamp positioned at one end of a plunger, and adapted to produce the FIM and matrix on the envelope.

14. The printer according to claim 13 wherein each stamp is self-inking rubber stamp.

15. The printer according to claim 12 wherein the marking means for the matrix also permits printing the written address on the envelope.

16. The printer according to claim 10 including additional marking means for printing of a postal permit number on the envelope.

17. The printer according to claim I0 wherein the plunger is activated electrically.

18. The printer according to claim 9 including a resilient pad located on a lower surface in the slot of the jig where the location of the envelope is to marked.

19. The printer according to claim 10 wherein the stamp prints a postal permit number on the envelope.

20. The printer according to claim 19 wherein the plunger is activated electrically.

21. The printer according to claim 19 including a resilient pad located on a lower surface in the slot of the jig where the location of the envelope is to marked.

* * * * *